United States Patent [19]

Cannon et al.

[11] 3,970,559

[45] July 20, 1976

[54] DRAIN GUARD

[76] Inventors: Thomas Cannon; Frances G. H. Cannon, both of 3557 Hamlet Place, Chevy Chase, Md. 20015; Jane E. H. Cowan, 10277 Gainsborough Road, Potomac, Md. 20854; Bernard McCarthy, 8918 Simpson Lane, Clinton, Md. 20735

[22] Filed: Dec. 19, 1974

[21] Appl. No.: 534,586

[52] U.S. Cl. ..... 210/166

[51] Int. Cl.[2] ..... E03F 1/00

[58] Field of Search..... 285/DIG. 19, DIG. 22; 210/163, 164, 166, 463

[56] References Cited

UNITED STATES PATENTS

| | | | |
|---|---|---|---|
| 2,859,875 | 11/1958 | Wilkie | 210/163 |
| 3,040,895 | 6/1962 | Sisk | 210/164 |
| 3,670,894 | 6/1972 | Friedl | 210/164 |
| 3,674,149 | 7/1972 | Donalson | 210/163 |
| 3,751,078 | 8/1973 | O'Brian | 285/DIG. 22 |
| 3,784,235 | 1/1974 | Kessler et al. | 285/DIG. 22 |
| 3,809,412 | 5/1974 | Glover | 285/DIG. 22 |

FOREIGN PATENTS OR APPLICATIONS

| | | | |
|---|---|---|---|
| 1,044,037 | 11/1958 | Germany | 210/163 |

*Primary Examiner*—Theodore A. Granger
*Attorney, Agent, or Firm*—Cushman, Darby & Cushman

[57] ABSTRACT

A drain guard is disclosed having a tubular body with a funnel-shaped portion at its upper end. The tubular body has an annular recess extending about the inside periphery thereof proximate the bottom end of the guard. The recess receives a sealing grommet therein for sealing the space between a tube on which the guard is positioned and the inner periphery of the tubular portion of the guard. Stop lugs are positioned about the inner periphery of the tubular portion of the guard at the junction of the funnel-shaped end portion thereof for limiting the upward movement of the tube on which the guard is positioned through the drain guard. A liquid permeable seat is positioned on the funnel-shaped end portion of the drain to permit the ingress of water or other liquids with respect to the drain guard. In an alternative embodiment of the invention, a rubber grommet is affixed to the inside periphery of the drain guard at the junction of the tubular and funnel shaped portions thereof with the grommet serving to limit the upward movement of the tube on which the guard is positioned and to seal the space between the guard and the tube to inhibit the passage of liquids therebetween.

8 Claims, 3 Drawing Figures

DRAIN GUARD

BACKGROUND OF THE INVENTION

This invention relates to an improved fitting for drainage systems and more particularly relates to a vent or drain guard.

In the past, drain and vent guards have been provided which were adapted to receive or be mounted on the upper end of a drain pipe or stack to protect the drain or stack against the ingress of foreign substances while facilitating access thereto by a plunger or "snake", if necessary. An example of such a prior art drain or vent guard is disclosed in U.S. Pat. No. 1,577,464 issued to Joseph High. This reference discloses a guard which includes a tubular body having a sleeve-like portion terminating in a bell of flared portion with a grid positioned on the top thereof for permitting the ingress and egress of fluids with respect thereto. An annular flange is formed about the junction of the sleeve-like portion and the flared portion against which the upper edge of a stack or drain is seated. The drain guard is fixed to the stack or drain by means of okum and lead which, as is known in the art, has a number of drawbacks. Thus, the okum and lead form a trap basin for water and sediment bacteria to accumulate, thus creating possible health hazards to those in the vicinity of the guard. Further, the use of lead and okum necessitates melting of lead and limits the types of materials which may be used to form the drain or vent guard and in addition, in areas such as roofs and in chemical laboratories, the process of heating the lead is prohibitive thereby requiring more complex vent guard configurations to be used. Another drawback to the High vent guard is that the process of affixing the guard to a drain pipe or vent stack takes considerable time because of the requirement of melting the lead and positioning the lead and okum in the guard.

It therefore is an object of this invention to provide an improved vent guard.

It is another object of this invention to provide a drain or vent guard which can be easily installed on location without requiring the heating or melting of sealing compounds.

It is yet another object of this invention to provide an improved drain or vent guard which can be easily and efficiently positioned on a drain pipe or vent stack.

SHORT STATEMENT OF THE INVENTION

Accordingly, this invention relates to a drain or vent guard having a tubular body with a funnel-shape portion at its upper end for receiving a liquid permeable seat therein to permit the ingress and egress of liquids or gases with respect thereto. The tubular body of the guard has an annular recess extending about the inside periphery thereof, proximate the bottom end, for receiving a sealing grommet therein. The seating grommet seals the space between a drain pipe or vent stack and the inner periphery of the tubular portion of the guard. Thus, the guard of the present invention can be easily installed on location by positioning a grommet in the tubular portion thereof and then positioning the guard over the drain pipe or vent stack.

In an alternate embodiment of the invention, the drain guard is formed with a tubular body having a funnel-shaped portion at its upper end for receiving a fluid permeable seat therein for permitting the egress and ingress of fluids with respect thereto. At the junction of the tubular body portion and the funnel-shape portion is bonded an annular rubber grommet which limits the upward movement of a drain pipe or vent stack within the guard and in addition, seals the space between the drain pipe or vent stack and the inside periphery of the guard from the passage of liquids or gases therebetween. This vent guard requires only a single installation step, i.e., positioning the vent guard over the top of a drain pipe or vent stack.

BRIEF DESCRIPTION OF THE DRAWINGS

Other objects, features and advantages of the present invention will be more fully appreciated from the following detailed description, appended claims and the accompanying drawings in which:

DETAILED DESCRIPTION OF THE PREFERRED EMBODIMENT

Figure 1:
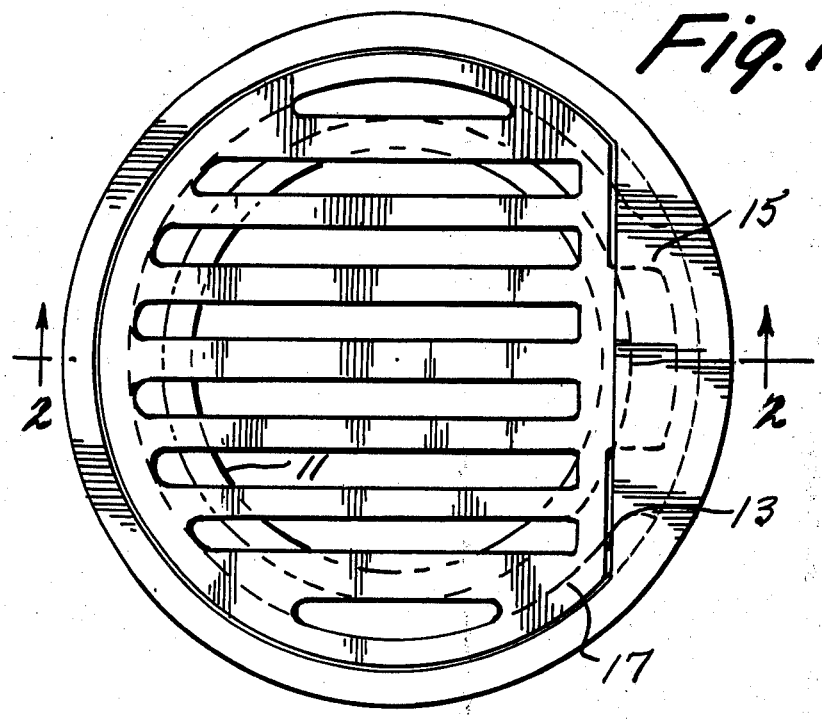
FIG. 1 is a plan view of the guard of the present invention.
Figure 2:
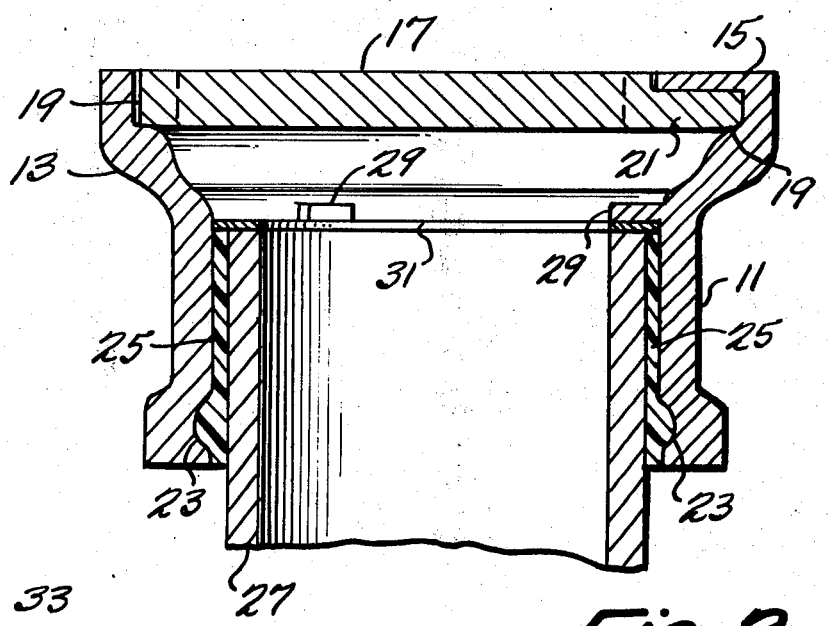
FIG. 2 is a vertical section view taken along the lines 2—2 of FIG. 1.

Refer now to FIGS. 1 and 2 where there is illustrated the preferred embodiment of applicants' invention. As illustrated, the drain or vent guard includes a tubular body portion 11 which is terminated in an upper funnel or dished shape portion 13. The funnel shape portion 13 is relatively short, having a considerably shorter length than the length of the sleeve-like tubular portion 11. A fillet 15 formed integral with the side walls of the guard extends inwardly over the funnel-shape portion 13. A cover 17, illustrated in FIG. 1, is positioned within the upper portion of the funnel portion 13 and rests on a semicircular shoulder 19 formed in the funnel-shaped portion of the guard. The cover 17 is formed to fit the opening of the funnel 13. The cover is formed at its underside with an under-hanging outstanding lip 21 shaped to underlie the fillet 15 and to form a hinge-like lock for preventing accidental displacement of the cover 17.

An annular recess 23 is formed proximate the bottom of the tubular portion 11 of the guard for receiving and securing a sleeve-like grommet 25 therein. The grommet 25 serves to seal the space between the inside periphery of the tubular portion 11 and the outside of a drain pipe or vent stack 27. At the junction of the tubular portion 11 and the funnel portion 13 is formed a plurality of retaining members 29 which are preferably formed integral with the body of the drain guard. These retaining members limit the upward movement of the drain pipe or vent stack 27 through the guard as illustrated in FIG. 2. In order to prevent liquid from settling on the end of the pipe 27 and on the end of the grommet 25, an annular steel ring 31 is positioned between the limiting members 29 and the ends of the grommet 25 and the pipe 27.

It should be understood that the preferred embodiment of the invention can be formed of plastic materials, copper, steel or cast iron materials and the grommet 25 may be formed of any suitable compressible material which is substantially impermeable to fluids such as, for example, rubber.

The installation of the drain of the present invention is quite simple and requires only a two-step process. Thus, the grommet 25 is first inserted in the lower end of the drain and then the drain is positioned over and pushed downwardly on the pipe 27 to thereby provide a drain pipe or vent guard connection which is fluid-tight, easy to install, limits the accumulation of water or sediment around the inside of the drain and most importantly, permits speedy installation of the drain in location.

Figure 3:
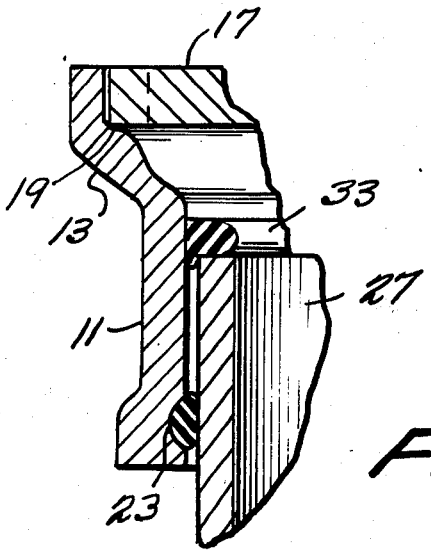
FIG. 3 is a vertical section view of an alternate embodiment of the present invention.

Refer now to FIG. 3 which is a side section view of an alternative embodiment of the present invention. As illustrated, the drain includes a tubular body portion 11 which is terminated at the upper end thereof in a flared or funnel portion 13. The structure of the flared or funnel portion 13 is similar to that illustrated in the first embodiment and includes a fillet 15 for receiving a fluid permeable cover plate such as illustrated by the numeral 17 in FIG. 1. At the junction of the tubular portion 11 and the funnel portion 13 is bonded a rubber or rubberized grommet 33 about the inside periphery of the drain. The grommet 33 serves a dual function, namely, to limit the upward movement of a drain pipe or vent stack 27 within the drain and in addition seals the space between the pipe 27 and the inside periphery of the tubular portion 11 so that fluids, such as gas or water, cannot pass therebetween. In addition, the grommet 33 is tapered so that water or sediment passing into the drain does not accumulate about the junction of the grommet 33 and the funnel-portion 13. If desired, a recess 23 may be formed in the tubular portion of the drain for receiving an O-ring sealing member to further insure that fluids, such as water, do not pass upwardly between the pipe 27 and the drain to the upper portions of the drain.

In this embodiment, installation requires only a single step, namely, positioning the drain over the pipe 27 and pressing same down against the pipe so that the area between the pipe 27 and the drain walls is sealed. Thus, the drain illustrated in FIGS. 1 and 2 or in FIG. 3 requires no time-consuming lead heating steps such as required in the prior art, thereby substantially reducing the time required for fitting the guard onto a drain pipe or vent guard. In addition, because hot lead and okum is not required, any type of material such as plastic, copper, steel or cast iron may be utilized to form the drain. Further, because lead and okum is not required, the problem of the accumulation of water and sediment bacteria is overcome so as to thereby improve the safety of the drain guard of the present invention.

While the present invention has been disclosed in connection with a preferred embodiment thereof, it should be understood that other obvious modifications of the present invention may fall within the spirit and scope of the following claims.

What is claimed is:

1. A drain guard comprising:

a tubular body having a funnel-shaped portion at its upper end, said tubular body having an annular recess extending about the inside periphery thereof proximate the bottom end thereof, said recess receiving a sealing grommet therein for sealing the space between a pipe on which said guard is positioned and the inner periphery of said tubular portion of said guard, means for limiting the upward movement of said pipe in said guard and a fluid permeable seat positioned on said funnel end portion of said drain, said means for limiting the upward movement of said pipe in said guard comprises a plurality of limiting members integrally formed with said guard and extending inwardly from the inner periphery thereof at the junction of the tubular and funnel portions thereof.

2. The drain guard of claim 1 further comprising an annular metal ring positioned between said plurality of limiting members and the upper end of said pipe, said annular ring preventing fluid from accumulating on the end of said pipe.

3. The drain guard of claim 2 wherein said vent guard is formed of a plastic material.

4. The drain guard of claim 2 wherein said vent guard is formed of cast iron.

5. A drain guard comprising a tubular body having a funnel-shaped portion at its upper end, a liquid permeable seat positioned on said funnel portion of said drain guard, an annular grommet bonded to the inside periphery of said drain guard proximate the junction of said tubular and said funnel portions thereof, said annular grommet limiting the upward movement of a pipe within said drain guard and sealing the space between said pipe and the inside periphery of said tubular body from fluids entering the drain guard through said liquid permeable seat, and an annular recess extending about the inside periphery thereof proximate the bottom end thereof, said recess receiving an O-ring seal for sealing the space between said pipe and the inner periphery of said tubular portion of said guard.

6. The drain guard of claim 5 wherein said annular grommet consists of rubber.

7. The drain guard of claim 6 wherein said drain guard is formed of plastic material.

8. The drain guard of claim 6 wherein said drain guard is formed of cast iron.

* * * * *